US005947034A

United States Patent [19]

Belka et al.

[11] Patent Number: 5,947,034

[45] Date of Patent: Sep. 7, 1999

[54] WORK STATION

[75] Inventors: Allen B. Belka, Wayland; Ronna L. Jacobs, Douglas; Brian D. T. Alexander, Fennville, all of Mich.

[73] Assignee: Haworth, Inc., Holland, Mich.

[21] Appl. No.: 08/890,914

[22] Filed: Jul. 10, 1997

[51] Int. Cl.[6] ..... A47B 35/00

[52] U.S. Cl. ..... 108/50.01; 108/92

[58] Field of Search ..... 108/69, 97, 98, 108/92, 90, 32, 28, 50.01; 297/102

[56] References Cited

U.S. PATENT DOCUMENTS

| | | | |
|---|---|---|---|
| D. 118,484 | 1/1940 | Salomon . | |
| D. 286,233 | 10/1986 | Schreiner . | |
| D. 321,447 | 11/1991 | Newhouse . | |
| D. 370,571 | 6/1996 | Newhouse et al. . | |
| D. 389,336 | 1/1998 | Moore . | |
| D. 389,667 | 1/1998 | Moore . | |
| 581,127 | 4/1897 | McCorkle . | |
| 808,318 | 12/1905 | Thomas et al. . | |
| 1,528,855 | 3/1925 | Smith . | |
| 1,818,606 | 8/1931 | Burks . | |
| 1,898,666 | 2/1933 | Isaacson . | |
| 1,911,959 | 5/1933 | Kern et al. . | |
| 2,090,176 | 8/1937 | Besancon . | |
| 2,153,422 | 4/1939 | Kroman . | |
| 2,305,244 | 12/1942 | Erickson . | |
| 2,480,233 | 8/1949 | Fuller . | |
| 2,520,490 | 8/1950 | Boward . | |
| 2,607,052 | 8/1952 | Le Roy | 297/182 X |
| 2,938,574 | 5/1960 | Brown | 297/182 |
| 4,094,547 | 6/1978 | Zampino et al. | 297/182 |
| 4,569,498 | 2/1986 | Ermanski . | |
| 4,605,988 | 8/1986 | Nienhuis et al. . | |
| 4,612,863 | 9/1986 | Vonhausen et al. | 108/28 |
| 4,852,500 | 8/1989 | Ryburg et al. . | |
| 4,914,873 | 4/1990 | Newhouse . | |
| 4,938,366 | 7/1990 | Carroll . | |
| 5,009,335 | 4/1991 | Jonker . | |
| 5,024,167 | 6/1991 | Hayward . | |
| 5,120,117 | 6/1992 | Williams . | |
| 5,289,926 | 3/1994 | Lewis et al. . | |
| 5,317,977 | 6/1994 | Omessi . | |
| 5,357,873 | 10/1994 | Hilton | 108/92 X |
| 5,481,987 | 1/1996 | Maitland | 108/90 |
| 5,609,112 | 3/1997 | Meyer et al. . | |

FOREIGN PATENT DOCUMENTS

| | | | |
|---|---|---|---|
| 0 531 794 A1 | 3/1993 | European Pat. Off. . | |
| 1221737 | 6/1960 | France . | |
| 2607862 | 8/1977 | Germany | 297/182 |
| 9204035 | 5/1992 | Germany . | |
| 4-5910 | 1/1992 | Japan . | |
| 2204479 | 11/1988 | United Kingdom . | |

OTHER PUBLICATIONS

U.S. Serial No. 08/870, 954, Table with Article–Supportive Surround, filed Jun. 6, 1997 (Haworth Case 240) and drawings therefrom.

U.S. Serial No. 08/870, 789, Computer Work Station, filed Jun. 6, 1997 (Haworth Case 242) and drawings therefrom.

U.S. Serial No. 09/089, 533, Document Storage and Display Unit, filed Jun. 3, 1998 (Haworth Case 258) and drawings therefrom.

U.S. Serial No. 08/983 619, Rim Top Table, filed Dec. 31, 1997 (Haworth Case 229) and drawings therefrom.

U.S. Serial No. 08/983 618, Spacial Organizer for Papers, filed Dec. 31, 1997 (Haworth Case 231) and drawings therefrom.

(List continued on next page.)

*Primary Examiner*—Jose V. Chen

*Attorney, Agent, or Firm*—Flynn, Thiel, Boutell & Tanis, P.C.

[57] ABSTRACT

A work station which provides an increased surface display area to facilitate the display and organization of documents being used by a work station user, i.e. the user's work-in-progress. The work station includes multiple layers of work surfaces in combination with an article support section which is spaced upwardly above an uppermost work surface which effectively displays work-in-progress and increases the display area on which the documents and articles can be stored.

19 Claims, 10 Drawing Sheets

OTHER PUBLICATIONS

PCT/US97/10701, filed Jun. 5, 1997.
PCT/US97/10572, filed Jun. 5, 1997.
US 29/071758, filed Jun. 6, 1997.
US 29/071761, filed Jun. 6, 1997.
US 29/073261, filed Oct. 28, 1997.
US 60/019407 filed Jun. 7, 1996.
US 60/019425, filed Jun. 7, 1996.

WORK STATION

FIELD OF THE INVENTION

The invention relates to a work station for use in an office-type environment and more particularly, to a work station having multiple levels of work surfaces and an article support section spaced upwardly of the work surfaces which provides an increased surface display area, both vertically and horizontally, for displaying and accessing documents.

BACKGROUND OF THE INVENTION

Most offices provide conventional work surfaces such as tables and desks for supporting papers and the like. However, for jobs or projects which involve a large volume of paper, conventional work surfaces typically have a limited amount of table or desktop space. This limited space can make it more difficult to manage or control a large amount of papers or documents as they are being used. More specifically, the worker typically has a limited amount of space in which to spread out and display the documents. Further, even when the documents are spread out on the work surface, those documents that are stored in the areas of the work surface located farthest away from the worker typically are more difficult to access and view.

It is an object of the invention, therefore, to provide a work station which overcomes many of the difficulties associated with displaying and accessing documents on conventional work surfaces.

The invention relates to a work station which provides an increased surface display area which facilitates the display and organization of the documents being used by a worker, i.e. the worker's work-in-progress. In particular, the inventive work station includes multiple layers of work surfaces in combination with an article support section which is spaced upwardly above an uppermost work surface which more effectively displays work-in-progress and increases the display area on which the documents can be stored.

More particularly, the work station includes upper and lower work surfaces supported on a frame. The upper work surface is U-shaped and is substantially horizontal. The U-shaped upper work surface defines an open area between the opposite sides thereof, and the lower work surface is supported by the frame in this open area although it is spaced below the level of the upper work surface.

The lower work surface provides the primary area on which a user can work while the upper work surface surrounds this primary area and provides additional space on which documents and other articles can be stored or used. For example, not only can documents be stored on the upper work surface but office or computer equipment such as a monitor can be stored thereon. A gap is provided in the space between the upper and lower work surfaces along the back edge of the lower work surface to permit cabling such as for computers or other office equipment to be supplied to the lower work surface.

Additionally, the article support section extends along a rear edge of the upper work surface but is spaced upwardly therefrom. The article support section has an inclined forward facing surface as well as a flange extending along a lower edge thereof which defines a shelf. Accordingly, documents and the like can be stored on the article support section at an inclined angle which facilitates viewing and organization of the documents or other articles.

Further, the article support section is formed of a markable material such as a powder coated metal or resin material which forms a markable finish and allows a user to sketch and write on the inclined surface with a marker or other suitable writing utensil. The markable inclined surface is erasable to permit repeated use by the occupant.

The article support section can be formed as two separate sections which are located on the left and right sides of the user. The left and right sections are spaced apart so as to define an opening therebetween which is located directly in front of the user and allows a user to view the area located on the opposite side of the desk.

With this work station, a worker seated thereat normally works on the lower work surface while the upper work surface is readily available such as for the storage of documents or articles thereon. The upper work surface also can be used for writing such as when a user is standing. Further, the user also may use the markable surface for writing, sketching or taking notes on exposed surface areas adjacent to the documents. The worker can thereby work in this work station while being able to readily store, see and access documents located either on the upper and lower work surfaces, or on the article support section. The work station thereby makes it easier for a worker to organize his or her work-in-progress.

Other objects and purposes of the invention, and variations thereof, will be apparent upon reading the following specification and inspecting the accompanying drawings.

Figure 1:
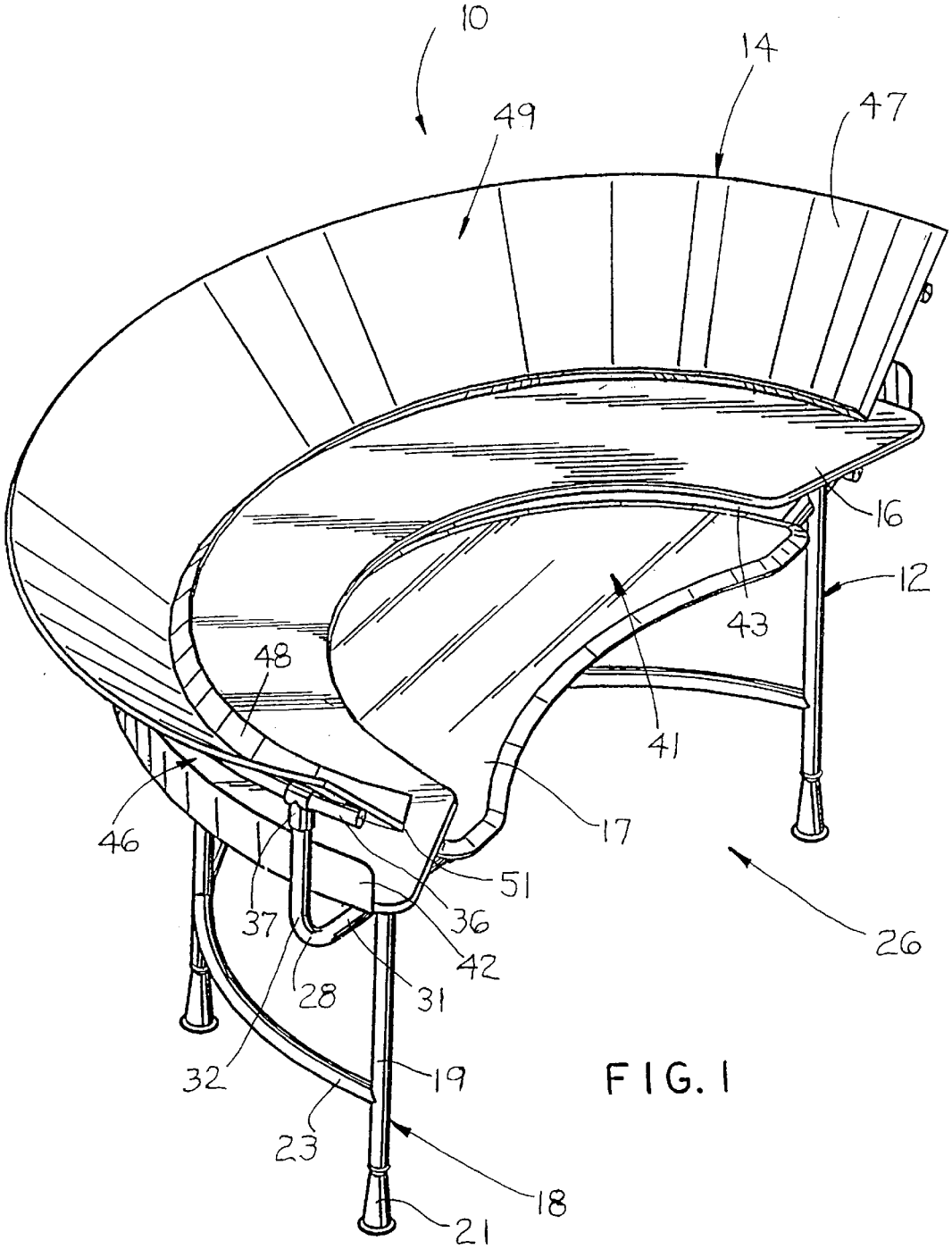
FIG. 1 is a perspective view of a first embodiment of a work station of the invention.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, the invention relates to a work station 10 having an increased storage and work area to facilitate storing, accessing and viewing documents and articles thereon. The work station 10 includes a base 12 having multiple work surface levels and an article support section 14 spaced upwardly therefrom.

Generally, the base 12 includes a U-shaped upper work surface 16 and a lower work surface 17 located in front of but below the upper work surface 16 to define at least two levels on which a work station user can work. Additionally, the article support section 14, which is spaced upwardly above the upper work surface 16, provides additional space for the storage of documents as well as a markable surface area for the user.

More particularly, the base 12 (FIGS. 1–4) includes a free-standing support frame 18 which supports the upper and lower work surfaces 16 and 17 thereon. The support frame 18 has a semi-circular shape when viewed from above and includes four vertical legs 19 which are disposed in load bearing engagement with the floor. The lower ends of the legs 19 include fixed support feet 21 although the support feet 21 may be replaced with conventional casters (not illustrated) if the work station 10 is to be made mobile.

The legs 19 are rigidly joined together in an open frame construction by upper and lower cross members 22 and 23 respectively. Generally, the cross members 22 and 23 are vertically spaced apart with the upper cross member 22 being connected to the upper ends of the legs 19.

More particularly, the cross members 22 and 23 have a semi-circular shape when viewed from above such that when the legs 19 and cross members 22 and 23 are joined together, the support frame 19 is U-shaped so as to define an open knee space 26 as seen in FIG. 1. The knee space 26 opens forwardly so as to accommodate the legs of a user. Preferably, the legs 19 and cross members 22 and 23 are formed of metal tubing or piping which are joined together by welding or other suitable fastening methods.

To support the article support section 14 thereon, the support frame 18 also includes four L-shaped uprights 28 which project upwardly from the rear side of the support frame 18. In particular, each upright 28 includes a horizontal section 31 which is joined to a respective one of the legs 19, and a vertical section 32 which projects upwardly therefrom.

Figure 2:
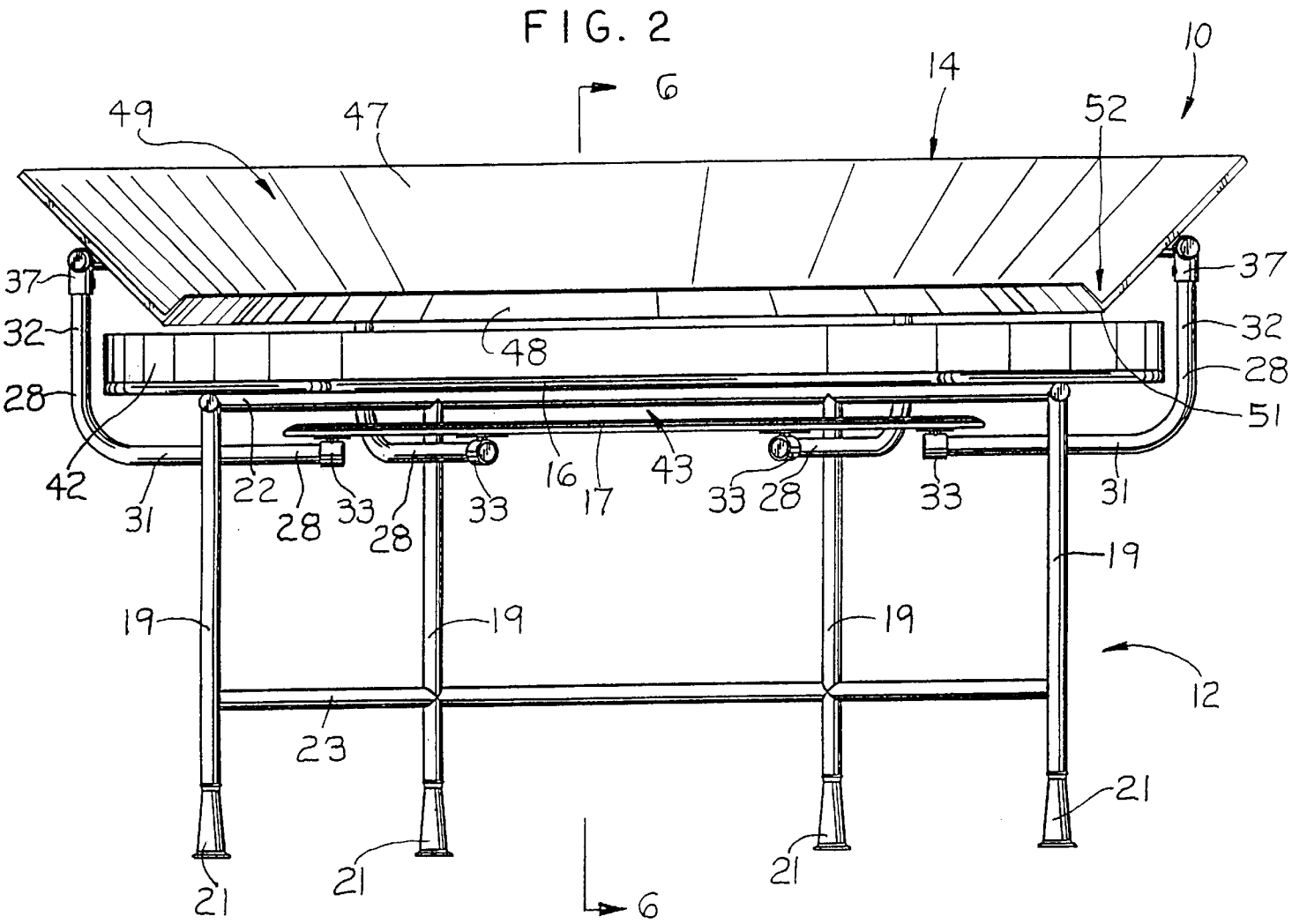
FIG. 2 is a front elevational view.
Figure 3:
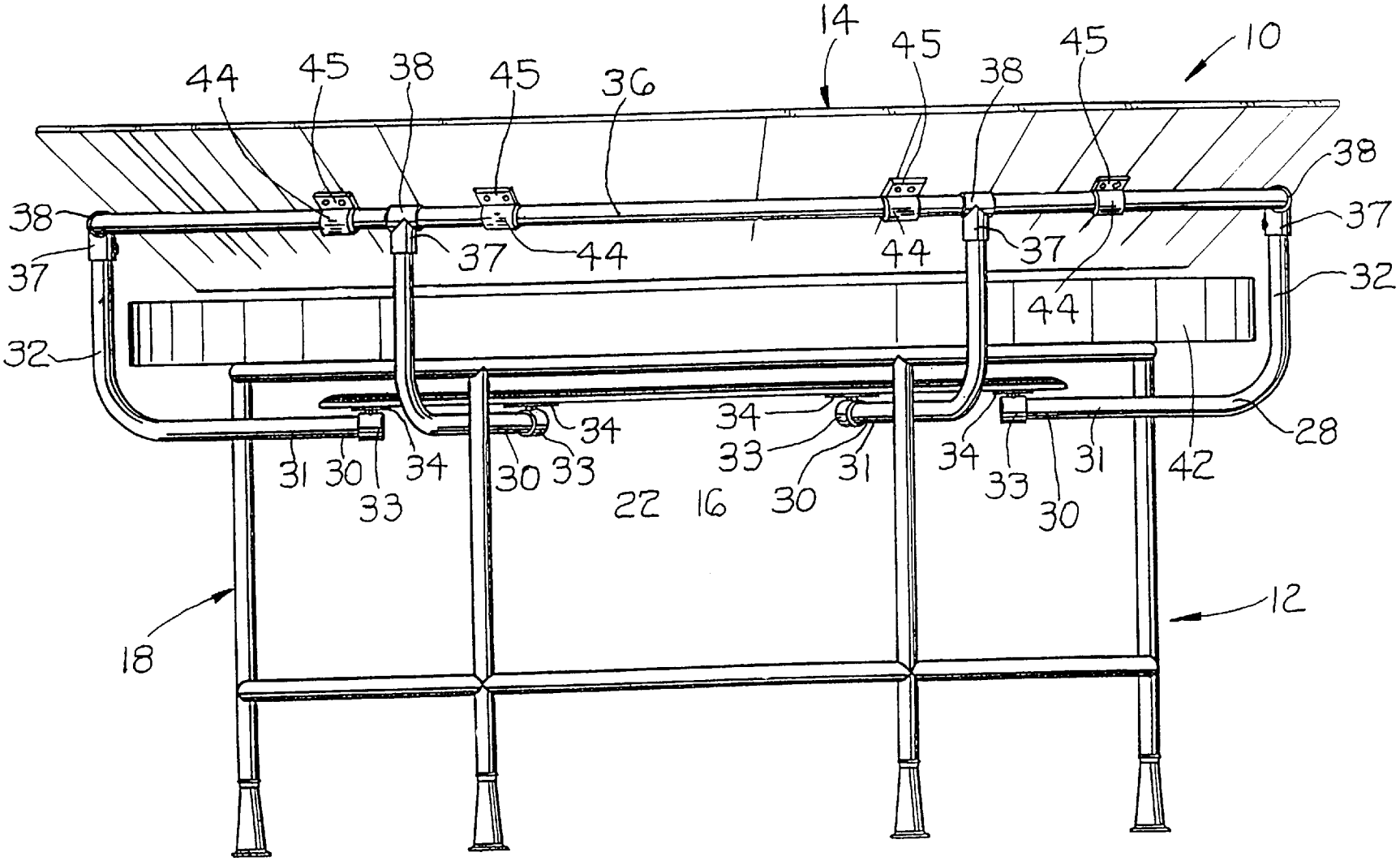
FIG. 3 is a back elevational view.
Figure 4:
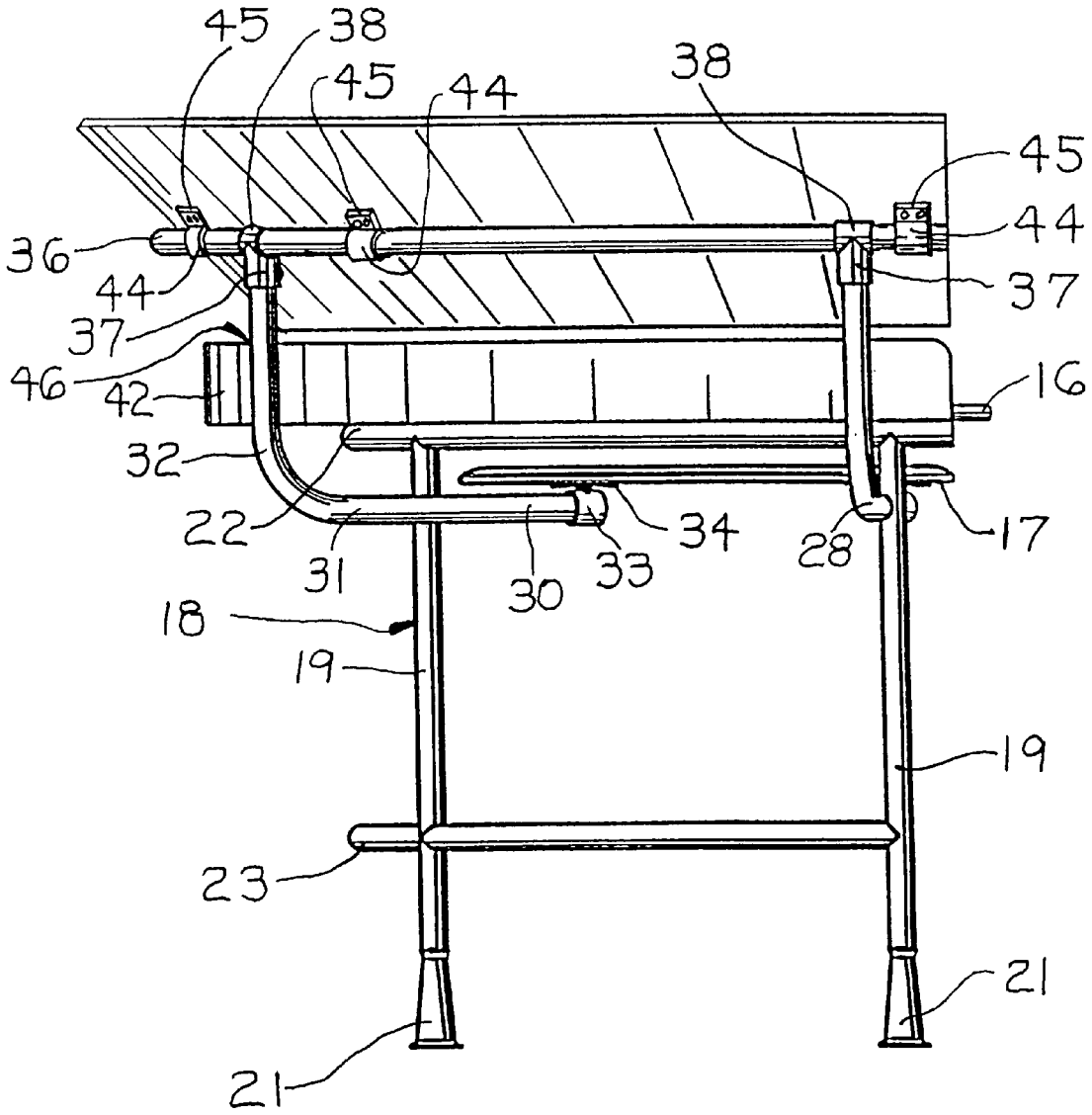
FIG. 4 is a left side elevational view.

Referring to FIGS. 2–4, the horizontal sections 31 of the uprights 28 are rigidly joined to the legs 19 proximate to but below the upper cross member 22. Once joined together, the opposite ends of the horizontal section 31 project away from opposite sides of the leg 19 in cantilevered relation therewith. While the two forwardmost uprights 28 extend generally sidewardly as seen in FIGS. 2 and 3, the two intermediate or rear uprights 28 extend in a front-to-back direction as seen in FIG. 4.

Each horizontal section 31 terminates at a free end 30 which supports a bracket 33 thereon. The bracket 33 includes a hollow horizontal section which slips over and is securely attached to the free end 30 of the horizontal section 31. This bracket 33 includes a horizontal plate 34 which faces upwardly to support the lower work surface 17 thereon as described in detail hereinafter.

As a result, the brackets 33 supported on the forwardmost legs 19 are spaced forwardly of and wider than the two brackets 33 being supported by the two rearward intermediate legs 19. Accordingly, four of the brackets 33 are provided which are spaced sidewardly and forwardly apart for supporting the lower work surface 17.

The ends of the horizontal section 31 opposite the free ends 30 project away from the legs 19 and support the vertical section 32 thereon. The vertical section 32 thereby is spaced radially outwardly away from the upper cross member 22 and extends vertically to a height above the upper cross member 22.

The upper ends of the uprights 28 support an additional top cross member 36 which has a semi-circular shape when viewed from above. In particular, the upper ends of the uprights 28 include T-shaped brackets or couplings 37 which have a vertical tubular section that is slid onto and secured to the upper ends of the uprights 28. The rigid tubular section supports an open-ended horizontal tube 38 which slidably receives the top cross member 36 therethrough. Thus, the top cross member is rigidly supported by the four uprights 28.

When the top cross member 36 is mounted on the uprights 28, the top cross member 36 preferably is spaced above as well as radially outwardly from the upper cross member 22. Further, the top cross member 36 preferably is disposed concentrically with respect to the upper and lower cross members 22 and 23.

Preferably, all of the legs 19, uprights 28 and cross members 22, 23 and 36 are formed of a rigid tubular material such as steel tubing or the like. Once these components are joined together, the upper and lower work surfaces 16 and 17 are mounted to the support frame 18 in vertically spaced and horizontally offset relation.

More particularly, since the brackets 33 are located below the upper cross member 22, two vertically spaced apart mounting locations are provided. The upper cross member 22 defines one mounting location to which the upper work surface 16 is mounted, while the brackets 33 define the other lower mounting location which supports the lower work surface 17.

Figure 5:
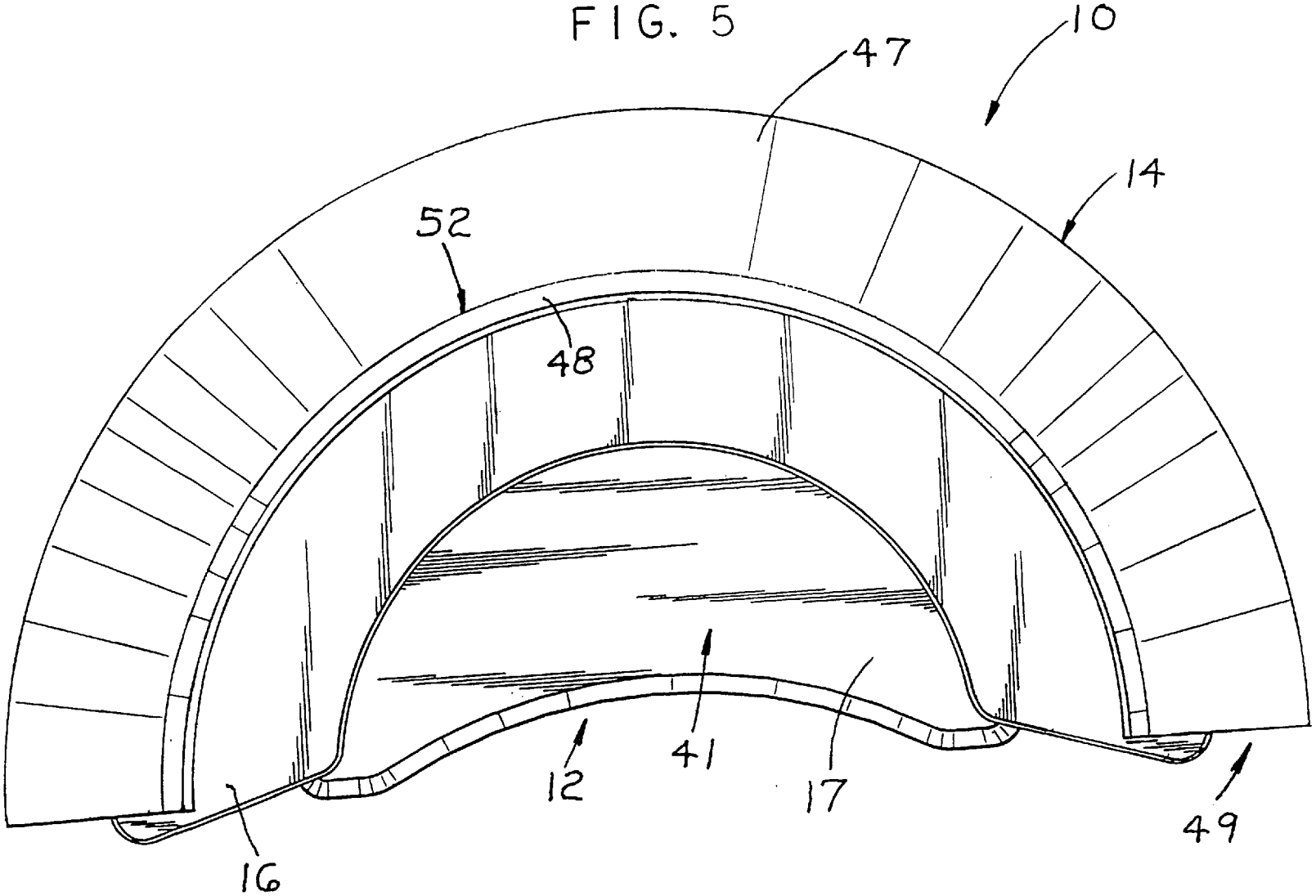
FIG. 5 is a top plan view.

The upper work surface 16 is horizontally enlarged and has a U-shape (as seen in FIG. 5) which overlies the upper cross member 22 (FIGS. 2–4). The upper work surface 16 is laid onto and rigidly secured to the upper cross member 22 by U-shaped clips (not illustrated) such that the upper work surface 16 is substantially horizontal to allow use of this area by the work station user.

Due to the U-shape of the upper work surface 16, the front edge of the work surface 16 defines an open area 41 (FIGS. 1 and 6) which opens forwardly therefrom.

Preferably, the upper work surface 16 also includes an upstanding back stop 42 which extends along the rear edge of the upper work surface 16 to prevent papers and articles from falling through the back of the work station 10. The back stop 42 is spaced radially inwardly of the uprights 28 so as to provide a space therebetween. The uprights 28, however, project vertically above the upper edge of the back stop 42 to support the article support section 14 thereon as described in detail hereinafter.

With respect to the lower work surface 17, the lower work surface 17 is spaced below the upper work surface 16 and is disposed generally within the open area 41 defined thereby. This lower work surface 17 defines the primary area in which a user works while permitting ready access to the upper work surface 16.

More particularly, the lower work surface 17 is mounted to the four brackets 33 which are supported in cantilevered relation on the support legs 19. The brackets 33 are arranged so as to be mounted along a rear edge of the lower work surface 17. In particular, the horizontal plates 34 of the brackets 33 support the work surface 17 and fasteners are engaged therebetween.

Figure 6:
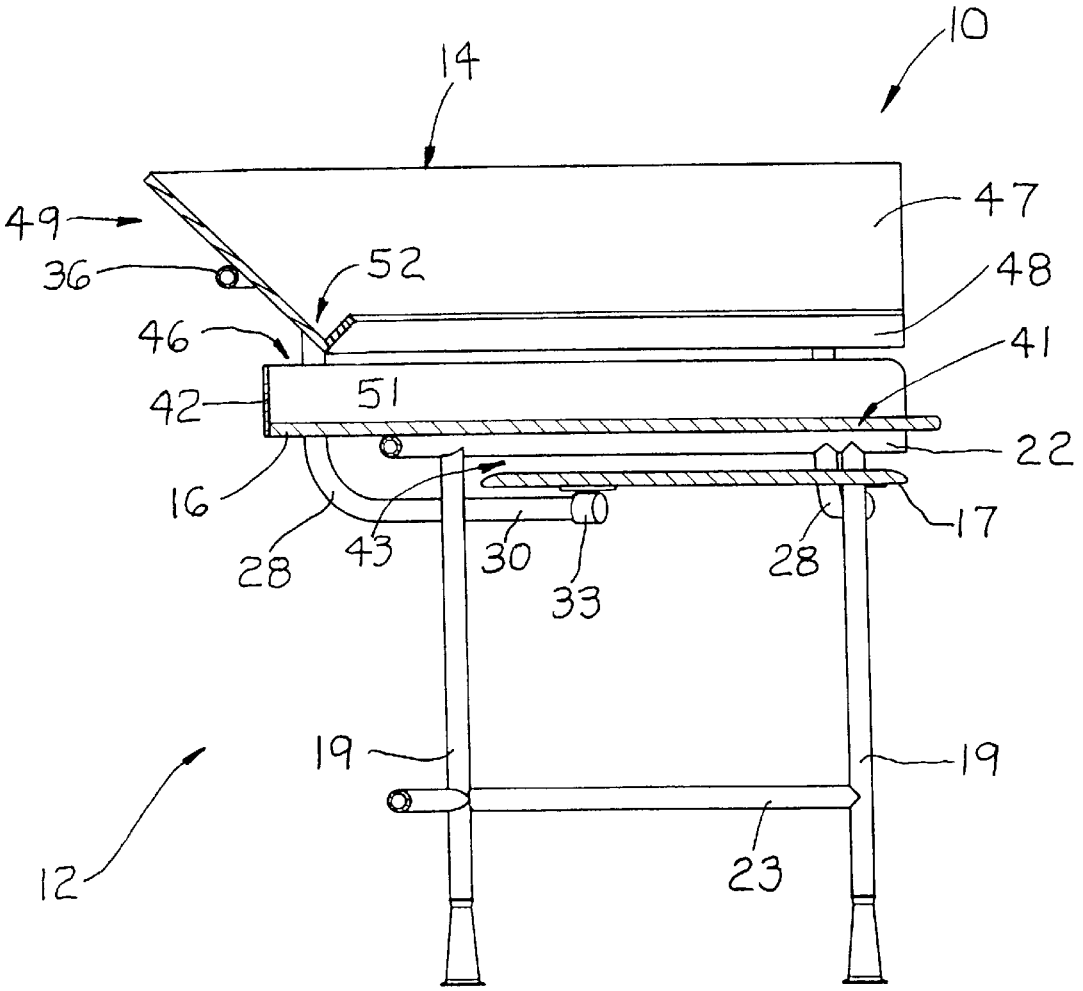
FIG. 6 is a side cross-sectional view as taken along the line 6—6 of FIG. 2.

The lower work surface 17 generally has a boomerang shape as seen in FIGS. 1 and 5 which is defined by a semi-circular rear edge and a front edge which has a shallow curve. The lower work surface 17 is disposed in the open area 41 and is sufficiently large such that the rear edge section thereof is disposed vertically below a front edge section of the upper work surface 16 as seen in FIG. 6, while the front edge of the work surface 17 extends sidewardly, generally between the front edges of the upper work surface 16 as seen in FIG. 5. As a result, at least two levels of work surfaces are provided in the work station 10.

Since the lower work surface 17 is spaced vertically below the upper work surface 16, an arcuate gap or access space 43 is formed which is disposed vertically therebetween and extends sidewardly along the rear edge of the lower work surface 17. The gap 43 permits cabling (not illustrated) such as for a computer keyboard, telephone or the like to be routed underneath the work surfaces 16 and 17 to the lower work surface 17.

Preferably, an additional back stop (not illustrated) is provided along the rear edge of the work surface 17 to prevent papers from slipping through the gap 43. The gap 43 is still provided between the top of this back stop and a bottom of the upper work surface 16.

If further equipment is located on the upper work surface 16, such cabling can be routed over the top of the back stop 42. Thus, cabling which extends between the upper and lower work surfaces 16 and 17 can be hidden from view from the front side of the work station 10.

To provide further storage space, the article support section 14 is mounted to the support frame 18. Generally, the article support section 14 extends horizontally along and is spaced vertically above the rear edge section of the upper work surface 16 so as to be readily accessible.

More particularly, the article support section 14 is formed as a one-piece unit which mounts to the top cross member 36 of the support frame 18. The article support section 14 is U-shaped when viewed from above (FIG. 5) although it projects radially outwardly beyond the rear edge of the upper work surface 16. Preferably, however, at least the front edge section of the article support section 14 overlies the rear edge section of the upper work surface 16.

The article support section 14 is mounted to the top cross member 36 by a plurality of brackets 44 which are formed the same as the brackets 33. The brackets 44 include an open-ended tubular section which is slid horizontally onto the top cross member 36, and a mounting plate 45 which is fastened to the back side of the article support section 14.

When the article support section 14 is rigidly supported by the top cross member 36, the article support section 14 preferably is suspended above the upper work surface 16 such that an additional access space 46 (FIGS. 4 and 6) is formed therebetween above the back stop 42 which permits routing of cabling therethrough as previously discussed herein.

To facilitate the storage of documents and articles, the article support section 14 generally has a partial frustoconical shape which is defined by a front inclined surface 47. The inclined surface 47 is inclined outwardly, and faces radially and forwardly toward a user to facilitate access thereto.

As illustrated in FIGS. 1, 5 and 6, the lower edge of the inclined surface 47 includes a flange or ledge 48 which projects radially inwardly therefrom so that the article support section 14 effectively defines a shelf 49. In particular, the ledge 48 has a declined angle relative to the inclination of the inclined surface 47 and is joined to the ledge 48 at a corner 51.

Preferably, the height of the inclined surface 47 as measured between the upper and lower edges thereof is significantly greater than the width of the ledge 48 as measured between the inner and outer edges thereof. The inclined surface 47 and ledge 48 thereby define a horizontally extending channel 52 which opens upwardly.

Accordingly, papers and other articles can be stored on the shelf 49 in a generally upright position due to the inclined angle of the surface 47. Further the channel 52 not only facilitates the storage of documents but also allows for the storage of markers or other writing utensils therein. Thus, a user can readily store, view and access documents and articles on the shelf 49.

Preferably, the inclined surface 47 is a markable material which can be written on by conventional markers or other writing instruments. Preferably, the article support section 14 is formed from a powder coated metal which forms a markable finish although masonite may be used which has a markerboard laminate surface. Other suitable markable materials may also be used. The markable material also is erasable. Thus, the inclined surface 47 defines a surface upon which a user or groups of users can readily write or sketch. This markable inclined surface 47 is located nearer eye level than the work surfaces 16 and 17 to permit ready reference to the markings and sketches thereon.

While the lower work surface 17 preferably is disposed at a conventional work surface height for a seated user, the legs 19 also can have a longer length for a user who is standing. More specifically, the upper work surface 16 can be disposed at a height which is greater than conventional work surface heights and in particular, is disposed approximately 40 inches above the floor. Thus, the work surface 16 is particularly suited for use in a standing position in addition to providing storage space.

Figure 7:
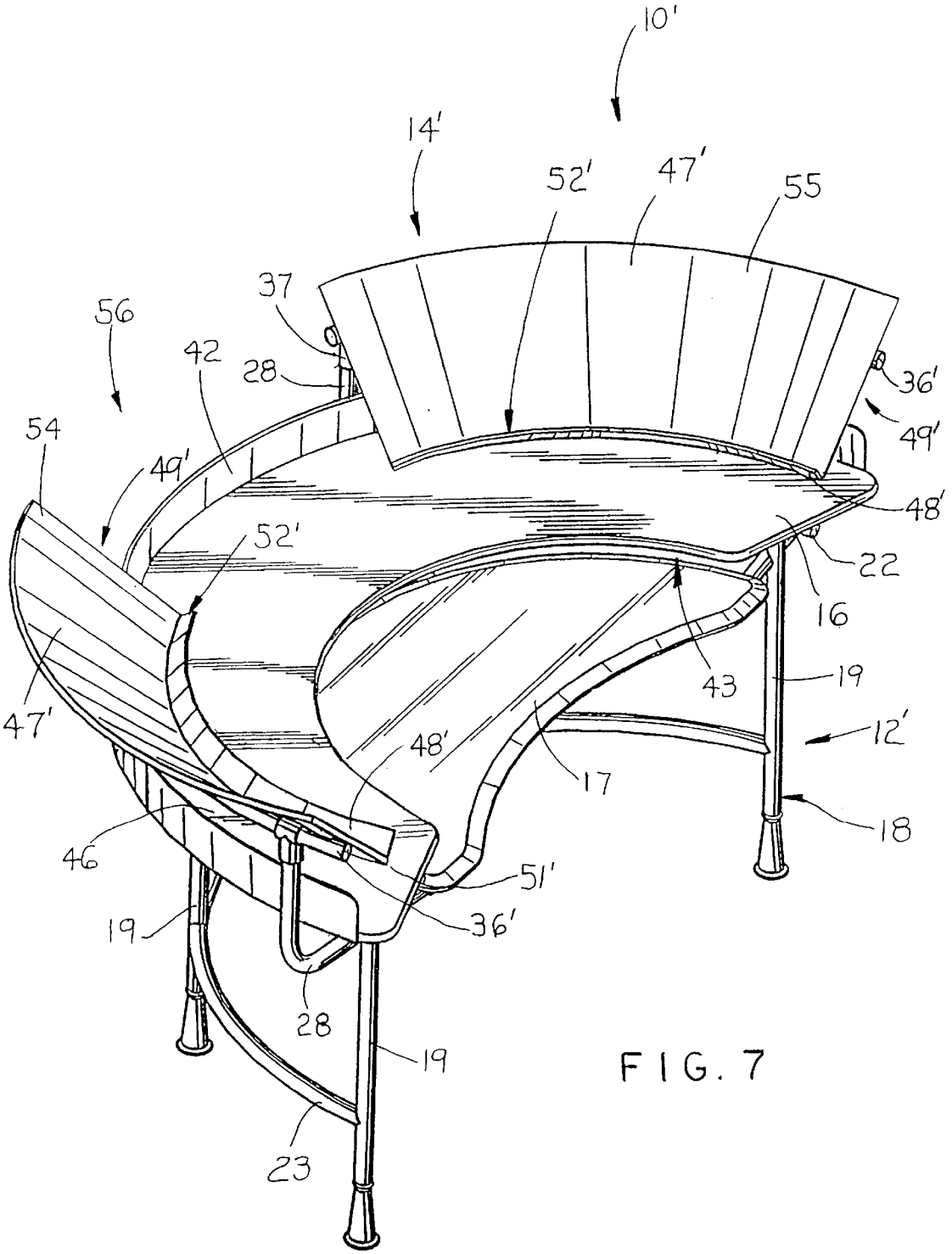
FIG. 7 is a perspective view of a second embodiment of the invention.
Figure 8:
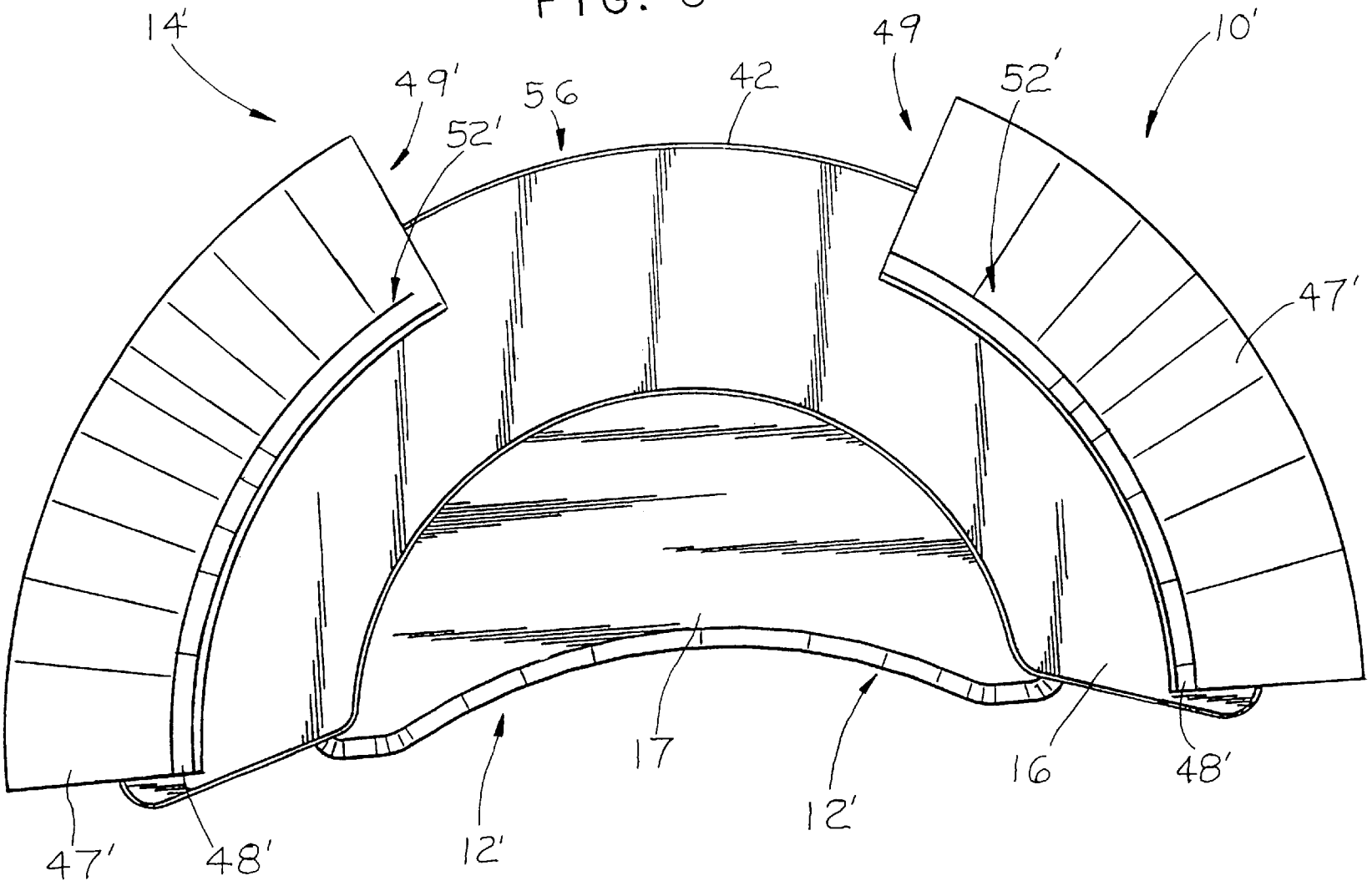
FIG. 8 is a top plan view of the second embodiment.

In the alternative embodiment illustrated in FIGS. 7 and 8, reference numerals identifying modified components similar to those described herein are designated with a prime (′). The remaining components which are the same as those described above use the same reference numerals.

In the work station 10′, the support frame 18, upper work surface 16 and lower work surface 17 are formed the same as those described above and thus, a more detailed description of these components is not believed necessary.

The work station 10′, however, provides an article support section 14′ defined by at least two separate support panels or sections 54 and 55 which only extend along a partial length of the rear edge of the upper work surface 16. Generally, these support panels 54 and 55 are located on the left and right sides of the work station 10′ and are each supported by two of the uprights 28. In particular, a short top cross member 36′ is supported by two uprights 28 by the brackets 37.

The support panels 54 and 55 are sidewardly spaced apart so as to define an intermediate space 56 therebetween. This intermediate space 56 preferably is located directly in front of a user to allow the user to view the area located on the opposite side of the work station 10′. Since each support panel 54 and 55 also includes a ledge 48′ and an inclined surface 47′ that defines a shelf 49′, documents and articles can be stored on either of the panels 54 and 55.

Further, the intermediate space 56 provides additional space on the upper work surface 16 for the storage of a conventional computer monitor.

Alternatively, the article support sections 14 and 14′ may also be formed without the ledges 48 or 48′ such that only the inclined surfaces 47 or 47′ are provided for use as a marker board.

Figure 9:
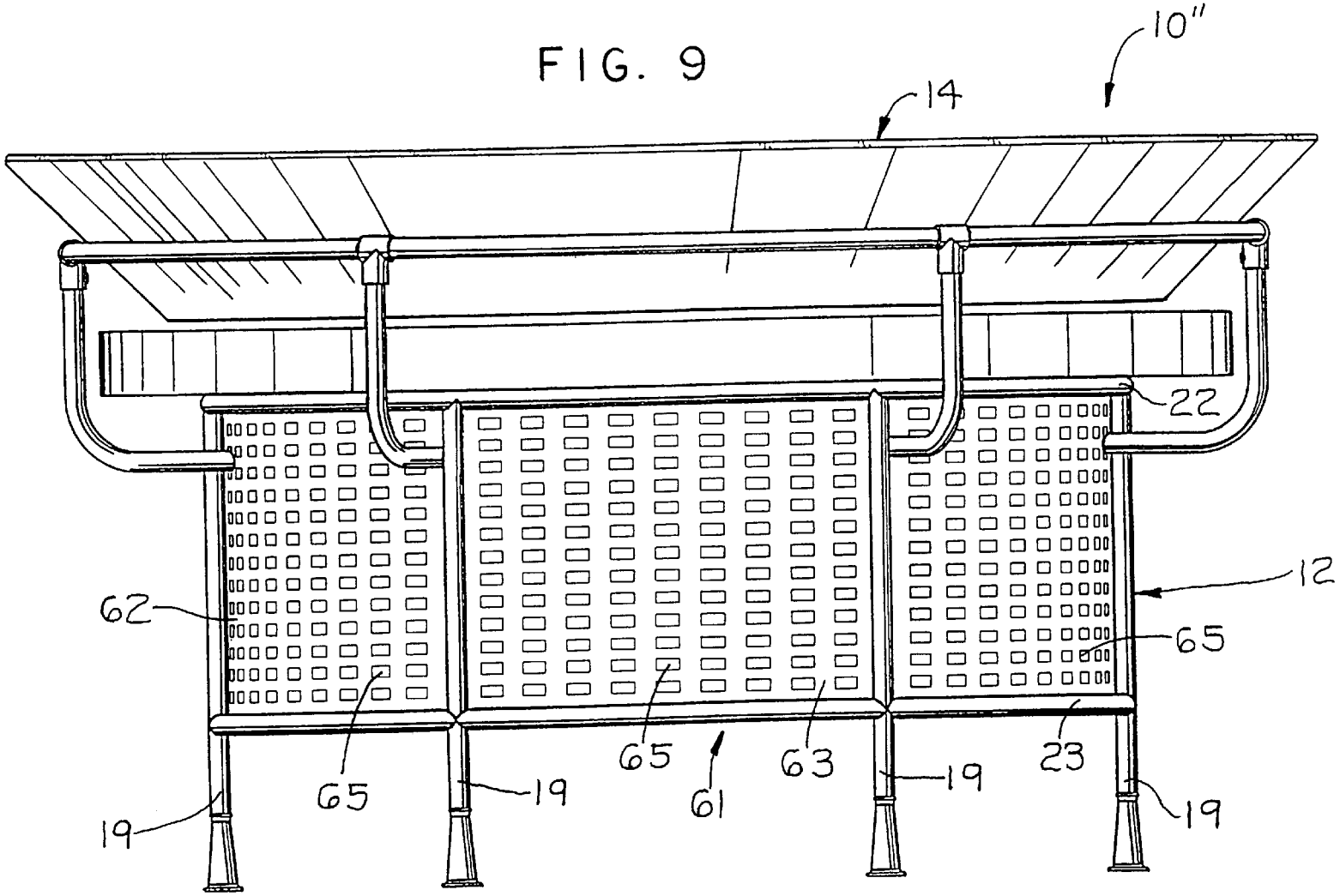
FIG. 9 is a back elevational view of a third embodiment of the invention.
Figure 10:
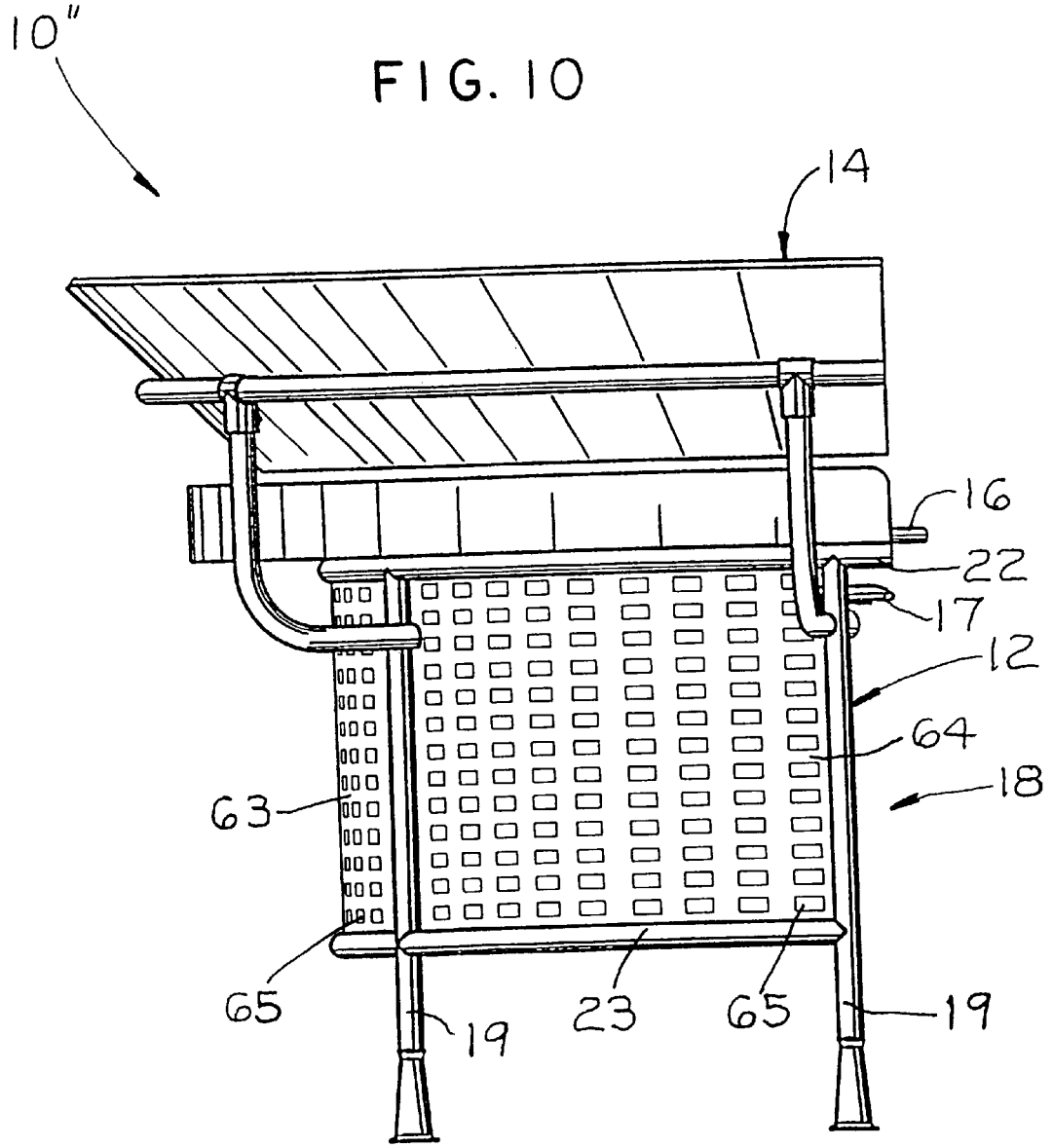
FIG. 10 is a left side elevational view thereof.

Referring to FIGS. 9 and 10, either of the work stations 10 and 10′ may be formed with a modesty panel 61 to form a further embodiment of the invention designated by reference numeral 10″. While FIGS. 9 and 10 illustrate the modesty panel 61 as mounted on the work station 10, this modesty panel is mounted to the work station 10′ in the same manner and thus a further description thereof is not believed necessary.

More particularly, the work station 10" is formed from the base 12 and the article support section 14. The modesty panel 61 comprises three separate panel sections 62, 63 and 64 which each mount between a spaced apart pair of legs 19. The panel sections 62–64 are formed of perforated metal or other suitable materials and have the opposite vertical side edges thereof mounted to the respective legs 19 by brackets (not illustrated). The panel sections 62–64 enclose the area defined sidewardly by a pair of legs 19 and vertically by the upper and lower cross members 22 and 23. The panel sections 62–64 also are curved when viewed from above and have substantially the same radius of curvature as the cross members 22 and 23 so as to provide a uniform arcuate surface for the modesty panel 61 which acts as a screen for the open area 26 defined by the base 12. Each panel section 62–64 also includes vertical and horizontal rows of perforations 65.

In use, for example with respect to the work station 10, the work station user typically sits in front of the work station 10 and primarily uses the lower work surface 17 such as for writing, word processing and organizing those documents which are in immediate use. However, where the user has finished with a document at least temporarily, the document can be stored either on the upper work surface 16 or the shelf 49. Even if the document is still being used, the upper work surface 16 and shelf 49 can be used to arrange and organize the documents. The inclined angle and vertical height of the shelf 49 allows a user to readily identify and access the documents where necessary. Further, the lower work surface 17, upper work surface 16 and shelf 49 can also be used for the storage and organization of articles and objects.

Further, since many work station environments allow for the frequent interaction of teams of workers, the formation of the article support section 14 from a marker board material allows the users to write or sketch upon the inclined surface 47. Also, the inclined-surface 47 can be used for the storage of self-adhering papers or papers provided with adhesives or fasteners such as where the ledge 48 is not provided on the article support section 14. The inventive work station 10 or work stations 10' and 10", which are usable in the same manner, thereby provide an increased amount of storage area that can be readily adapted to the particular needs of a worker.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A work station comprising:

a base frame;

a horizontally enlarged upper work surface mounted on said base frame, said upper work surface being U-shaped wherein a U-shaped front edge thereof defines an open area which opens forwardly away from said front edge;

a horizontally enlarged lower work surface mounted on said base frame, said lower work surface being spaced vertically below said upper work surface in the region of said open area and extending forwardly away from said front edge; and a U-shaped article support structure which is mounted to said base frame and extends horizontally at a height disposed above a rear edge section of said upper work surface, said article support structure having an upward facing ledge which extends horizontally along a front edge section thereof and an inclined front surface which extends upwardly and outwardly away from said ledge so as to define a shelf, said front edge section of said article support structure being spaced upwardly above said rear edge section of said upper work surface.

2. A work station according to claim 1, wherein said inclined front surface comprises a markable material.

3. A work station according to claim 2, wherein said upper work surface includes an upstanding wall along a back edge thereof, said wall being spaced vertically below said article support structure.

4. A work station according to claim 1, wherein said article support section extends horizontally so as to overlie said rear edge of said upper work surface.

5. A work station according to claim 1, wherein said article support section comprises a left section and a right section which are sidewardly spaced apart to define an intermediate open space therebetween.

6. A work station according to claim 1, wherein a horizontally elongate first space is disposed vertically between said upper work surface and said lower work surface, said first space extending horizontally along a rear edge of said lower work surface.

7. A work station according to claim 6, wherein a horizontally elongate second space is disposed vertically between said upper work surface and said article support section, said second space extending horizontally along a rear edge of said upper work surface.

8. A work station according to claim 7, wherein said base frame has a forward opening U-shape which defines an open space that opens forwardly, said upper and lower work surfaces overlying said open space and said first space opening rearwardly into said open space to define a passage between said open space and a top of said lower work surface.

9. A work station comprising:

a U-shaped base frame which opens forwardly to define an open space;

a plurality of work surfaces mounted to said base frame which extend rearwardly between a front section of said base frame and a rear section of said base frame so as to overlie said open space, said work surfaces being vertically spaced apart and horizontally offset wherein an upper one of said work surfaces is spaced above and rearwardly of a lower one of said work surfaces; and an article support section disposed vertically above said work surfaces along said rear section of said base frame, said article support section including an upward facing flange which extends horizontally along a lower edge of said article support section, and an inclined surface which extends upwardly and outwardly away from said flange to define a shelf.

10. A work station according to claim 9, wherein said article support structure is a markable material.

11. A work station according to claim 9, wherein said work surfaces are substantially horizontal.

12. A work station according to claim 9, wherein a front edge section of said upper one of said work surfaces overlies a rear edge section of said lower one of said work surfaces.

13. A work station according to claim 12, wherein a passage is formed between a vertically spaced apart pair of said work surfaces, said passage opening rearwardly into said open space.

14. A work station according to claim 12, wherein said upper one of said work stations has a U-shape defined by a U-shaped front edge thereof, said front edge overlying a U-shaped rear edge of said lower one of said work stations.

15. A work station according to claim 9, wherein said base frame defines a plurality of mounting locations which are vertically spaced apart, each of said mounting locations supporting one of said work surfaces.

16. A work station comprising:

an upright leg structure adapted for supporting engagement on and projection upwardly from a floor;

a horizontally enlarged worksurface mounted on an upper portion of said leg structure, said worksurface defining thereon a generally horizontally enlarged and substantially planar upper work area which extends between front and rear edges of said worksurface;

an article support structure disposed generally in vertically spaced relation above and extending horizontally along at least part of the length of said rear edge of said worksurface, said article support structure including a bottom upwardly facing ledge which extends horizontally along the article support structure and at a rear edge is fixedly joined to an article support wall which projects upwardly but is inclined rearwardly with respect to the worksurface, said bottom ledge being spaced vertically upwardly from said work area to define a vertical clearance space therebetween; and a support arrangement which stationarily secures said article support structure in said vertically spaced relation with respect to said worksurface, said support arrangement including a support arm which at an upper end thereof is stationarily secured to a rear side of said article support wall, said support arm projecting downwardly from said article support structure adjacent the rear edge of said worksurface and being stationarily secured to one of said worksurface and said leg structure.

17. A work station according to claim 16, wherein the article support wall defines thereon an inclined front surface defined by a hard markerboard-type material.

18. A work station according to claim 17, wherein said worksurface is generally U-shaped and at least a portion of said rear edge has a convex curvature as the rear edge extends horizontally, and wherein said article support structure is disposed above the rear edge portion having said arcuate convex curvature, said article support structure having a convex arcuate curvature in the horizontal extent thereof corresponding to the curvature of the rear edge portion.

19. A work station according to claim 17, wherein the worksurface is generally U-shaped and includes a center portion joined between a pair of side portions, and a said article support structure being mounted above the rear edge of each said side portion, a region located vertically above the rear edge of the center portion being free of said article support structure.

* * * * *